US005735100A

United States Patent [19]

Campbell

[11] Patent Number: 5,735,100

[45] Date of Patent: Apr. 7, 1998

[54] FOLDING TELESCOPIC PREFABRICATED FRAMING UNITS FOR NON-LOAD-BEARING WALLS

[75] Inventor: Ronald W. Campbell, White Rock, Canada

[73] Assignee: 527233 B.C. Ltd., Vancouver, Canada

[21] Appl. No.: 729,697

[22] Filed: Oct. 7, 1996

[51] Int. Cl.[6] ..... F04B 1/343; E04C 3/04

[52] U.S. Cl. ..... 52/645; 52/126.6; 52/481.2; 52/656.1; 52/690; 52/745.11; 52/745.14; 52/DIG. 4

[58] Field of Search ..... 52/645, 690, 483.1, 52/481.2, 481.1, 479, 656.1, 126.6, 745.1, 745.11, 745.14, DIG. 4

[56] References Cited

U.S. PATENT DOCUMENTS

| | | | |
|---|---|---|---|
| 2,058,386 | 10/1936 | Parsons | 52/481.2 X |
| 2,357,819 | 6/1944 | Greer . | |
| 3,078,968 | 2/1963 | Frick . | |
| 3,111,202 | 11/1963 | Costello | 52/645 |
| 3,195,191 | 7/1965 | Neisewander . | |
| 3,292,328 | 12/1966 | Lewis et al. | 52/DIG. 4 X |
| 3,494,405 | 2/1970 | Sandahl et al. . | |
| 3,583,466 | 6/1971 | Dreyer . | |
| 3,596,701 | 8/1971 | Cowan . | |
| 3,823,523 | 7/1974 | Wells | 52/645 X |
| 4,471,548 | 9/1984 | Goudie | 52/DIG. 4 X |
| 4,516,620 | 5/1985 | Mulhern . | |
| 4,546,591 | 10/1985 | Beltz | 52/645 |
| 4,612,848 | 9/1986 | Pollack | 52/645 X |
| 4,708,189 | 11/1987 | Ward . | |
| 5,471,805 | 12/1995 | Becker . | |
| 5,487,402 | 1/1996 | Clary . | |

*Primary Examiner*—Christopher T. Kent
*Attorney, Agent, or Firm*—Oyen Wiggs Green & Mutala

[57] ABSTRACT

A prefabricated framing unit for constructing non-load-bearing walls and partitions is disclosed. The framing units have vertical studs which both pivot in respect to the horizontal members, to allow collapsing of the unit, and telescope to allow the unit to be raised to fit the space between ceiling and floor without measuring and cutting to height.

11 Claims, 5 Drawing Sheets

FOLDING TELESCOPIC PREFABRICATED FRAMING UNITS FOR NON-LOAD-BEARING WALLS

TECHNICAL FIELD

The invention relates to the field of prefabricated partition framing and more particularly to prefabricated framing units for constructing non-load-bearing interior and exterior walls which are telescopic and fold for easy shipment and installation.

BACKGROUND ART

According to existing methods, interior non-load-bearing wall partitions for dividing space in office buildings, and exterior non-load-bearing walls, are constructed using wood or metal framing members which are measured and cut to length. The vertical components (studs) and horizontal components are fastened to each other and to the load-bearing structure, and holes are cut or drilled in the vertical members for accommodating wiring and plumbing. Such construction methods require skilled tradesmen on site due to the measuring and fastening required, and are time consuming and expensive.

To reduce the time and expense required for constructing non-load-bearing partitions, it has been attempted to provide prefabricated framing which can be manufactured off site and readily assembled on site into a partition wall. For example U.S. Pat. No. 3,078,968 issued Feb. 26, 1963 to Harvey Aluminum Inc. discloses a prefabricated partitioning system, however such systems have not found general acceptance because they are overly complicated.

DISCLOSURE OF INVENTION

The invention provides a prefabricated framing unit for constructing non-load-bearing walls and partitions. The framing units have vertical studs which both pivot in respect to the horizontal members, to allow collapsing of the unit, and telescope to allow the unit to be raised to fit the space between ceiling and floor without measuring and cutting to height.

The invention therefore provides a prefabricated framing unit for constructing a non-load-bearing wall or partition comprising:

a) a lower horizontal member;

b) an upper horizontal member;

c) a plurality of vertical members hingedly fastened at their upper and lower ends respectively to the upper and lower horizontal members;

wherein each vertical member comprises an outer element and an inner element, each the inner element adapted to slide within the outer element.

The invention also provides a method of constructing a non-load-bearing partition between a floor and a ceiling, comprising:

a) providing a prefabricated framing unit for constructing a non-load-bearing wall or partition comprising: i) a lower horizontal member; ii) an upper horizontal member; iii) a plurality of vertical members hingedly fastened at their upper and lower ends respectively to the upper and lower horizontal members; wherein each vertical member comprises an outer element and an inner element, the inner element adapted to slide within the outer element.

b) placing the lower horizontal member in position on the floor;

c) raising the upper horizontal member to a position with the vertical members aligned generally vertically;

d) fastening the lower horizontal member in position on the floor;

e) raising the upper horizontal member until it contacts the ceiling thereby causing the inner vertical member to slide relative to the outer vertical member 20;

f) fastening the upper horizontal in position to the ceiling; and g) fastening the outer and inner vertical members.

BRIEF DESCRIPTION OF DRAWINGS in drawings which illustrate a preferred embodiment of the invention:

BEST MODE(S) FOR CARRYING OUT THE INVENTION

Figure 4:
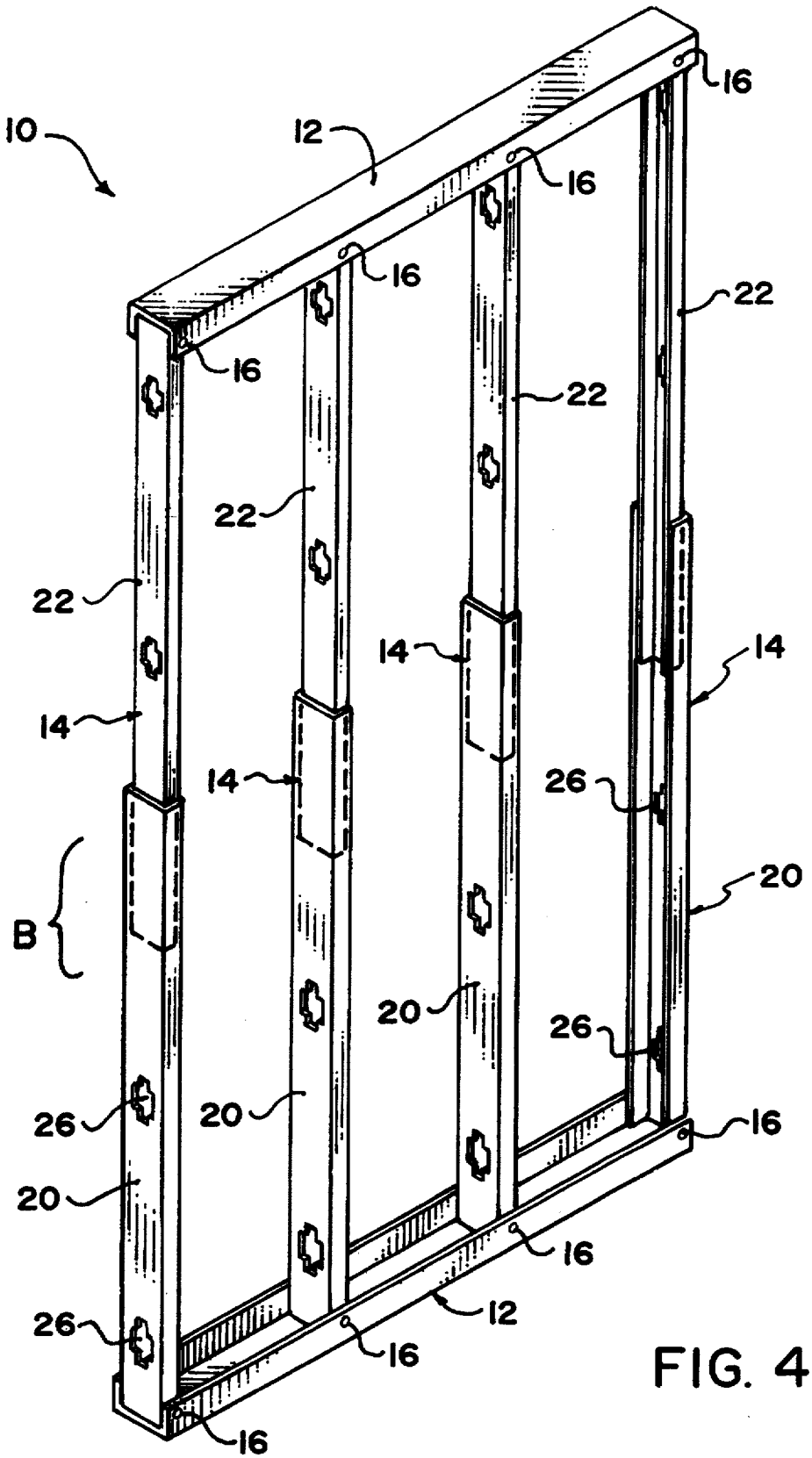
FIG. 4 is a perspective view of the framing unit shown in FIG. 2 in raised and extended position.
Figure 7:
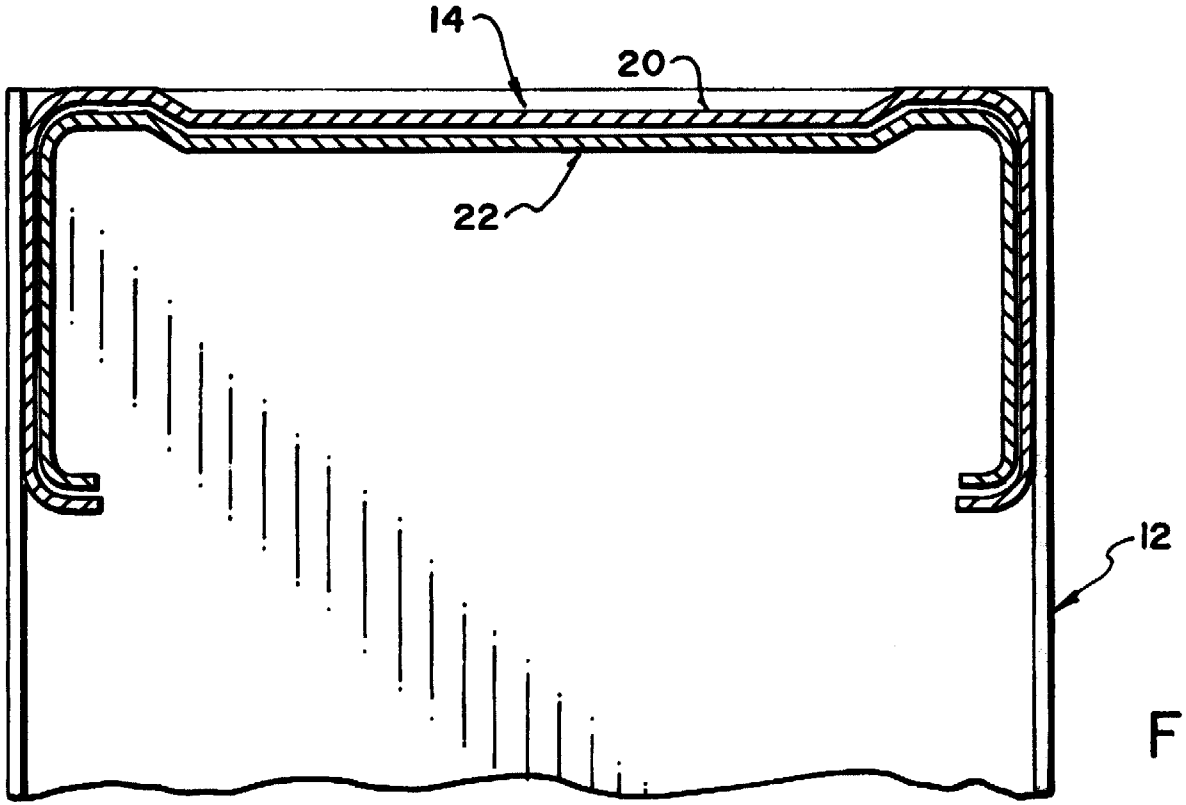
FIG. 7 is a detailed view of section A in FIG. 8.

With reference to the accompanying drawings, the prefabricated framing unit 10 comprises horizontal members 12 and vertical studs 14. A standard framing unit 10 is designed to fill an 8 foot by 4 foot space when fully raised and extended. To allow some flexibility the extended height as shown in FIG. 4 is 8 feet one inch, as further explained below. Studs 14 are hingedly connected to the horizontal members 12 at hinges 16, which typically are metal screws. Horizontal members 14 are preferably 28 gauge galvanized steel channel, 3⅝ inches in width and 1¼ inches deep. Studs 14 comprise outer stud members 20 and inner stud members 22 as shown in FIG. 4. Referring to FIG. 7, outer stud members 20 are preferably 3⅝" wide by 1⅜" deep and inner stud members 22 are 3½" wide by 1¼" deep, thus permitting the inner stud members 22 to slide freely within outer stud members 20 to permit extension and retraction of the studs. Pre-punched service openings 26 are provided in inner and outer stud members 20, 22 for purposes of wiring and plumbing. As shown in FIG. 4, the outer and inner stud members are preferably each about 4'6" in height so that with an extended height of 8'1" there is an overlap B of about 11".

Figure 5:
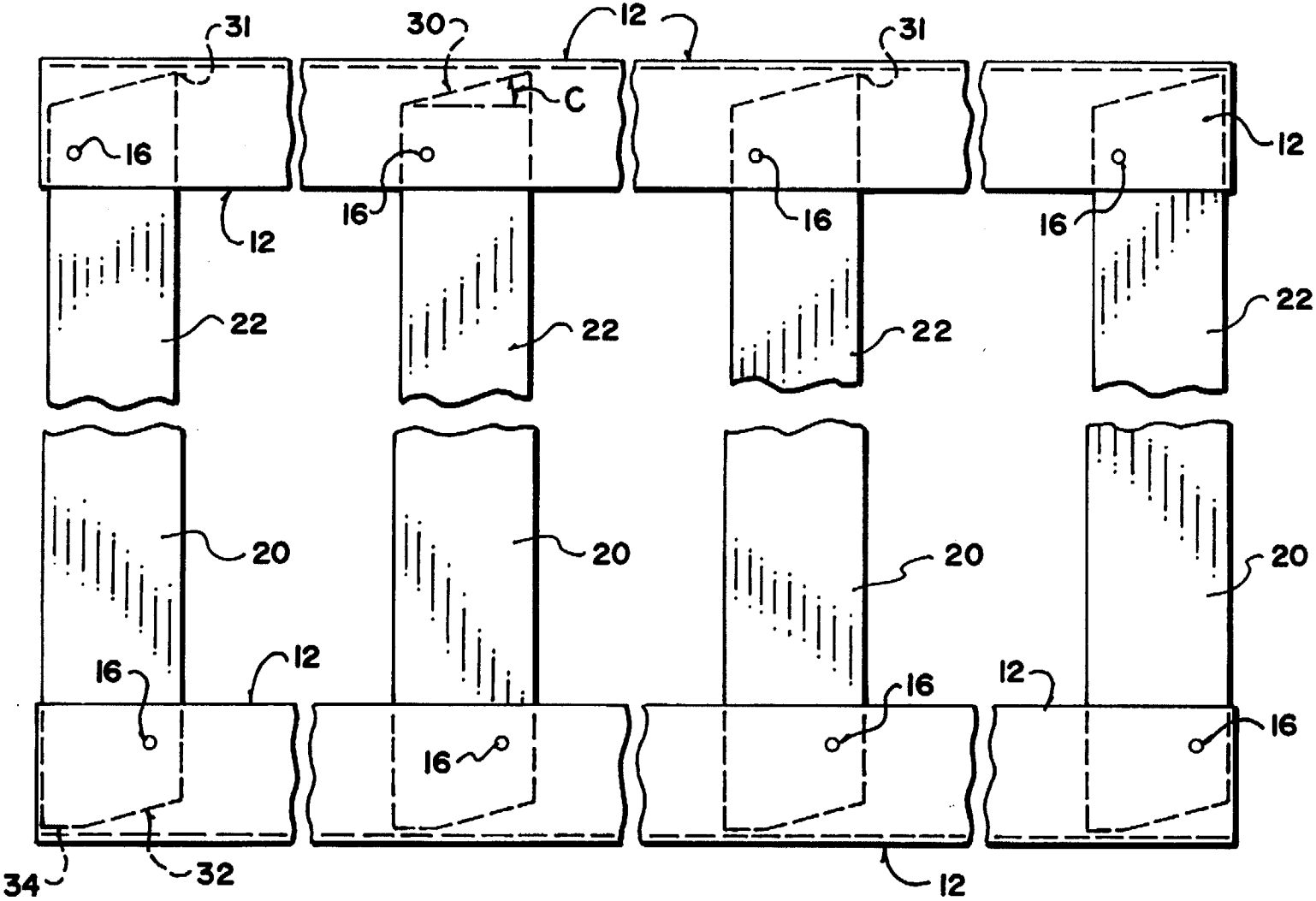
FIG. 5 is a partial elevation view of the framing unit shown in FIG. 4 illustrating the ends of the vertical studs in dotted outline.
Figure 6:
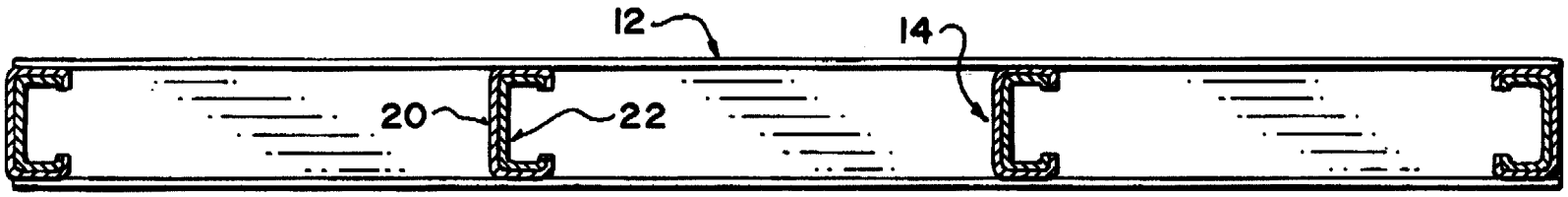
FIG. 6 is a cross-sectional view taken along lines 6—6 of FIG. 3.

FIG. 5 illustrates in detail the connection of studs 14 to horizontal members 12. Screws 16 fasten studs 14 to horizontal members 12 to permit relative pivoting. The upper end 30 of inner stud members 22 is positioned so that corners 31 contact member 12 to limit the rotation of the stud beyond a right angle to the horizontal member 12. The upper end 30 of inner stud members 22 is angled at an angle C of approximately 15 degrees to allow for installation on non-parallel floors and ceilings where the height of the vertical studs will be unequal. The lower end 32 of outer stud members 20 is also positioned so that corners 34 contact member 12 to limit the rotation of the stud beyond a right angle to the horizontal member 12. A short shoulder 34 is provided to give added support to the stud. The lower end 32 of outer stud members 20 angled at approximately 15 degrees in the opposite direction to thereby permit a variation of up to 30 degrees from the horizontal to accommodate non-parallel floors and ceilings where the height of the vertical studs will be unequal.

Figure 1:
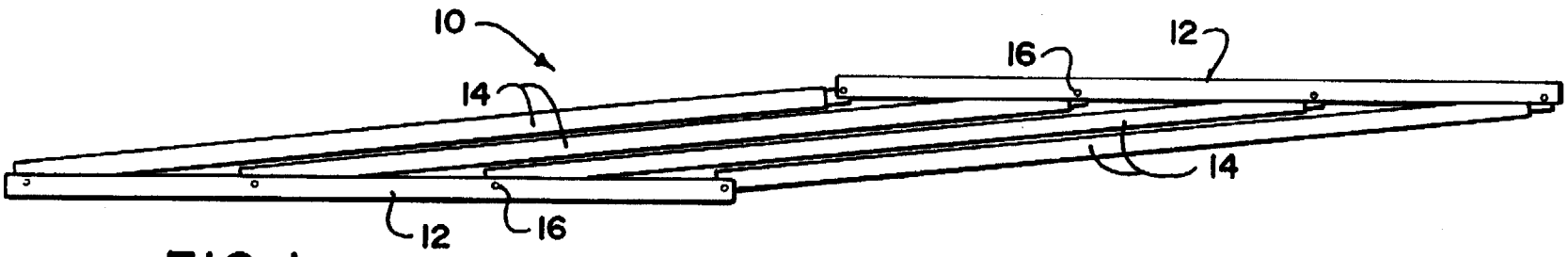
FIG. 1 is an elevation view of a framing unit according to the invention in collapsed condition.
Figure 2:
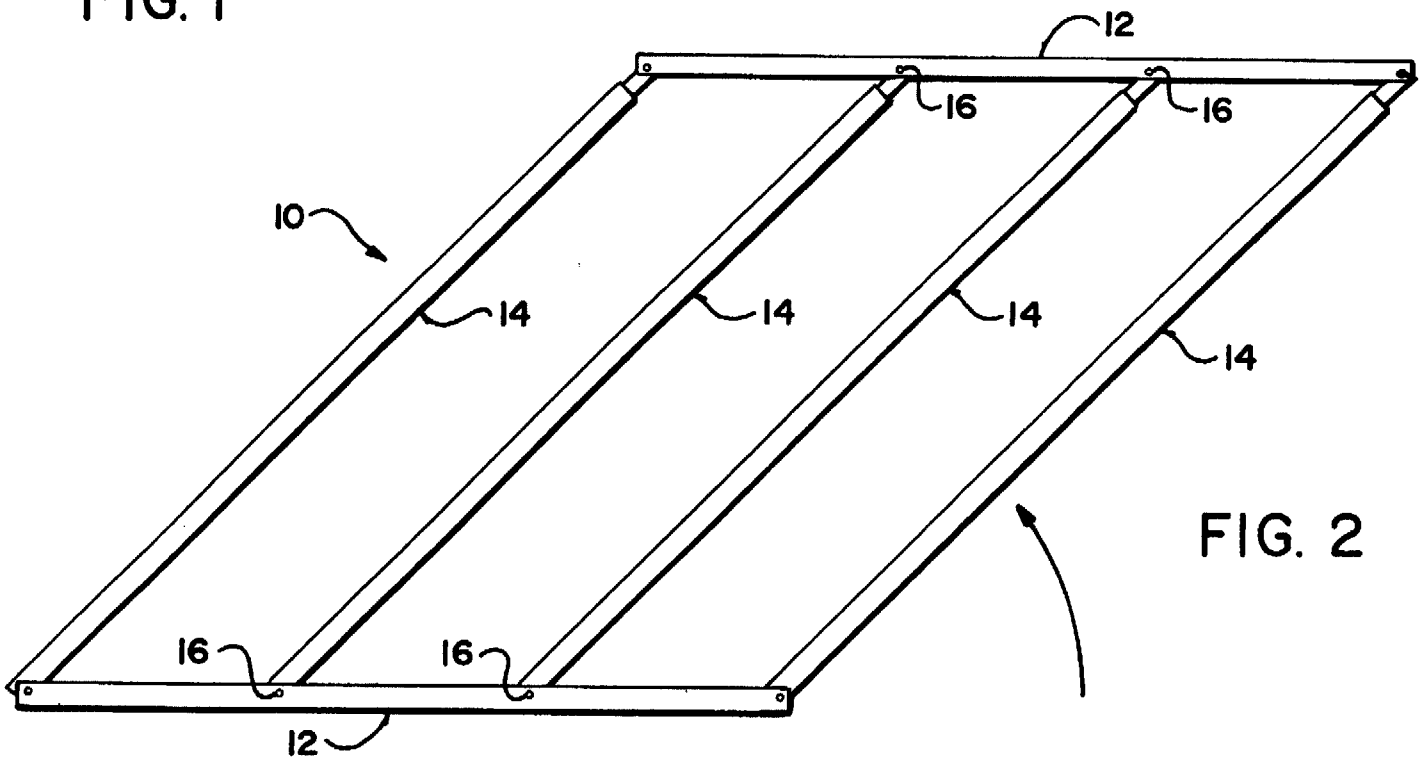
FIG. 2 is an elevation view of the framing unit shown in FIG. 1 in partly raised condition.
Figure 3:
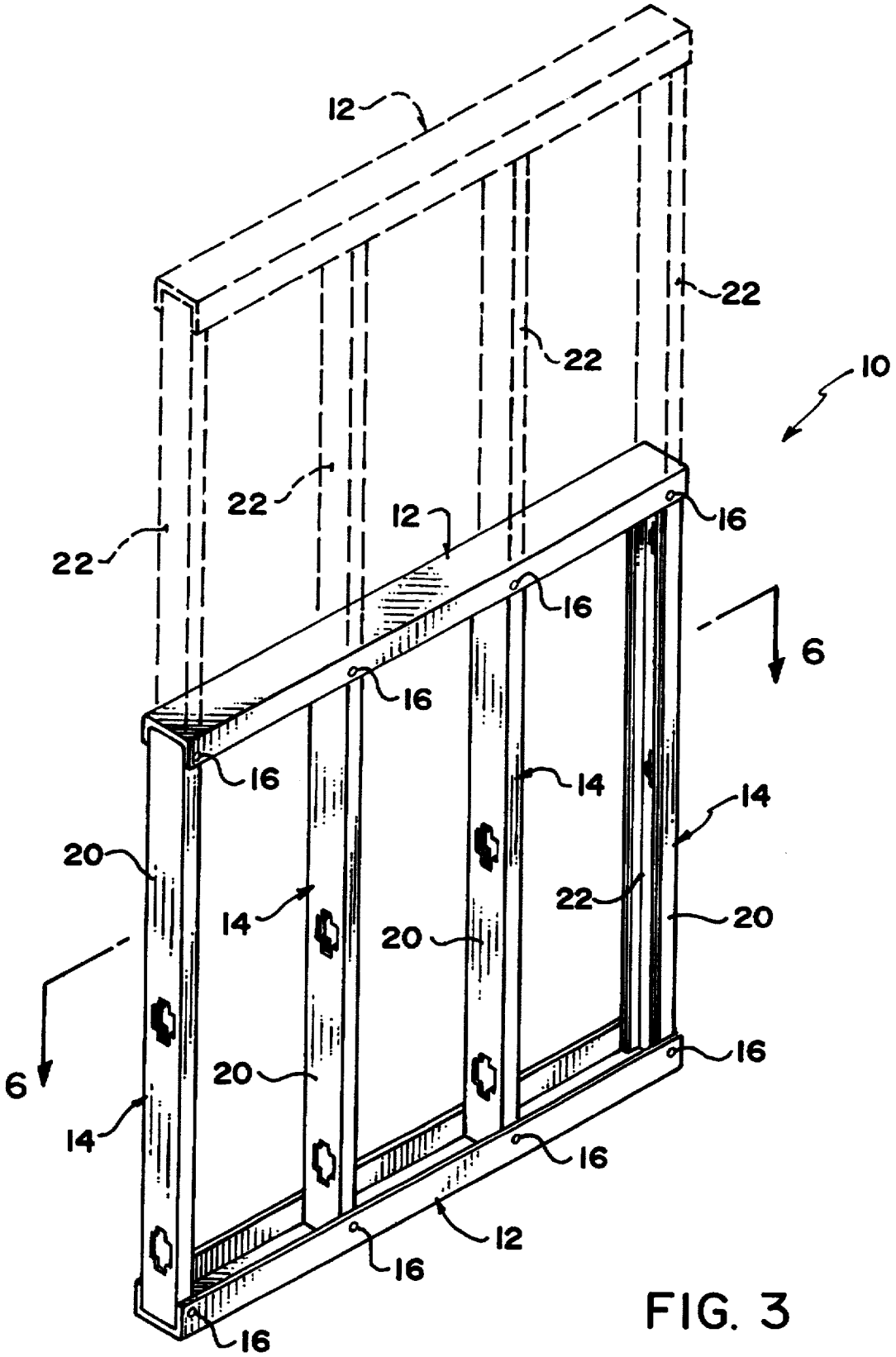
FIG. 3 is a perspective view of the framing unit shown in FIG. 2 in raised position, with the extended condition shown in phantom outline.

To install a partition using the invention, the framing unit 10 is manufactured off-site and is shipped to the site in collapsed condition as shown in FIG. 1. The location for the wall partition is marked on the floor with chalk, tape or the like, and the lower horizontal member 12 is laid in position on the floor. The upper horizontal member 12 is grasped and raised to the position shown in FIG. 3 with studs aligned vertically. The lower horizontal member 12 is fastened in position on the floor with screws, nails or the like. The upper horizontal member 12 is grasped and raised vertically to the position shown in FIG. 4, causing the inner stud members 22 to slide out from outer stud members 20, until the upper horizontal member 12 meets the ceiling (not shown). The upper horizontal member 12 is then fastened in position to the ceiling with screws, nails or the like. The outer and inner stud members 20, 22 are then fastened by screws or the like in the overlap area B. The required panelling can then be attached to the framing unit to complete the partition. Magnetic sheeting, consisting of panels which have integral magnets to attach to the steel framing of the invention, can be used for quick installation and removal of the wall partition.

It will be understood that the invention can accommodate uneven floor and ceilings since the studs 14 can be extended to different lengths respectively, with up to a 30 degree variance being accommodated. The vertical sizing of the unit is accomplished automatically without time-consuming measurement and cutting. Other sizes of units (e.g. 8' by 2') are also possible, as well as units incorporating door frames and/or window frames.

As will be apparent to those skilled in the art in the light of the foregoing disclosure, many alterations and modifications are possible in the practice of this invention without departing from the spirit or scope thereof. For example, different cross-section shapes and different sizes can be selected for the studs and horizontal members, and different materials are suitable for the components. Accordingly, the scope of the invention is to be construed in accordance with the substance defined by the following claims.

What is claimed is:

1. A prefabricated framing unit for constructing a non-load-bearing wall or partition comprising:

a) a lower horizontal member;

b) an upper horizontal member;

c) a plurality of vertical members hingedly fastened at upper and lower ends thereof respectively to said upper and lower horizontal members at spaced locations thereon;

wherein each said vertical member has an adjustable length and comprises an outer element and an inner element within and aligned parallel to said outer element, each said inner element adapted to slide within and parallel to said outer element thereby lengthening or shortening said vertical member, and wherein an upper end of one of said inner and outer elements is hingedly fastened to said upper horizontal member and an upper end of said other of said inner and outer elements is free to slide relative to said one of said inner and outer elements, and a lower end of the other of said inner and outer elements is hingedly fastened to said lower horizontal member and a lower end of said other of said inner and outer elements is free to slide relative to said other of said inner and outer elements.

2. The prefabricated framing unit of claim 1 wherein said horizontal and vertical members are manufactured from sheet metal.

3. The prefabricated framing unit of claim 1 wherein said upper and lower ends are adapted to prevent rotation of said vertical members beyond a right angle to said horizontal members.

4. The prefabricated framing unit of claim 3 wherein said upper and lower ends are angled to allow for installation on non-parallel floors and ceilings.

5. The prefabricated framing unit of claim 1 wherein said unit comprises four vertical members.

6. The prefabricated framing unit of claim 1 wherein said unit comprises three vertical members.

7. A method of constructing a non-load-bearing partition between a floor and a ceiling, comprising:

a) providing a prefabricated framing unit for constructing a non-load-bearing wall or partition comprising: i) a lower horizontal member; ii) an upper horizontal member; iii) a plurality of vertical members hingedly fastened at upper and lower ends thereof respectively to said upper and lower horizontal members; wherein each said vertical member has an adjustable length and comprises an outer element and an inner element within and aligned parallel to said outer element, said inner element adapted to slide within said outer element and parallel to said outer element thereby lengthening or shortening said vertical member, and wherein an upper end of one of said inner and outer elements is hingedly fastened to said upper horizontal member and an upper end of said other of said inner and outer elements is free to slide relative to said one of said inner and outer elements, and a lower end of the other of said inner and outer elements is hingedly fastened to said lower horizontal member and a lower end of said other of said inner and outer elements is free to slide relative to said other of said inner and outer elements;

b) placing said lower horizontal member in position on said floor;

c) raising said upper horizontal member to a position with said vertical members aligned generally vertically;

d) fastening said lower horizontal member in position on said floor;

e) raising said upper horizontal member until it contacts said ceiling thereby causing said inner vertical member to slide relative to said outer vertical member;

f) fastening said upper horizontal member in position to the ceiling; and g) fixing relative positions of said outer and inner vertical members.

8. The method of claim 7 comprising the further step of attaching panelling to said framing unit.

9. The method of claim 8 wherein said panelling comprises panels which have integral magnets.

10. A prefabricated framing unit for constructing a non-load-bearing wall or partition comprising:

a) a lower horizontal member;

b) an upper horizontal member;

c) a plurality of vertical members hingedly fastened at upper and lower ends thereof respectively to said upper and lower horizontal members at spaced locations thereon;

wherein each said vertical member has an adjustable length and comprises an outer element and an inner element within and aligned parallel to said outer element, each said inner element adapted to slide within and parallel to said outer element thereby lengthening or shortening said vertical member wherein said upper and lower ends are adapted to prevent rotation of said vertical members beyond a right angle to said horizontal members.

11. The prefabricated framing unit of claim 10 wherein said upper and lower ends are angled to allow for installation on non-parallel floors and ceilings.

* * * * *